US005730198A

United States Patent [19]

Sircar

[11] Patent Number: 5,730,198

[45] Date of Patent: Mar. 24, 1998

[54] METHOD OF FORMING PRODUCT HAVING GLOBULAR MICROSTRUCTURE

[75] Inventor: Subhasish Sircar, Richmond, Va.

[73] Assignee: Reynolds Metals Company, Richmond, Va.

[21] Appl. No.: 469,291

[22] Filed: Jun. 6, 1995

[51] Int. Cl.[6] ..... B22D 18/02; B22D 23/00

[52] U.S. Cl. ..... 164/4.1; 148/511; 148/549; 148/550; 164/122; 164/900

[58] Field of Search ..... 164/900, 80, 122, 164/47, 71.1, 476, 4.1; 148/549, 550, 557, 511, 689

[56] References Cited

U.S. PATENT DOCUMENTS

| | | | |
|---|---|---|---|
| 4,106,956 | 8/1978 | Bercovici . | |
| 4,415,374 | 11/1983 | Young et al. | 148/550 |
| 4,580,616 | 4/1986 | Watts . | |
| 4,621,676 | 11/1986 | Steward | 164/485 |
| 4,694,881 | 9/1987 | Busk . | |
| 4,706,730 | 11/1987 | Sanchez-Caldera et al. . | |
| 4,771,818 | 9/1988 | Kenney . | |
| 4,909,858 | 3/1990 | Reiso | 142/550 |
| 5,009,844 | 4/1991 | Laxmanan . | |
| 5,133,811 | 7/1992 | Kirkwood et al. | 148/550 X |
| 5,144,998 | 9/1992 | Hirai et al. . | |
| 5,306,365 | 4/1994 | Reighard | 148/689 X |
| 5,375,645 | 12/1994 | Brueker et al. | 164/900 |
| 5,571,346 | 11/1996 | Bergsma | 142/550 |

FOREIGN PATENT DOCUMENTS

| | | |
|---|---|---|
| 64-87040 | 3/1989 | Japan . |
| 789242 | 12/1980 | U.S.S.R. . |
| 2026363 | 2/1980 | United Kingdom . |
| 2112676 | 7/1983 | United Kingdom . |

OTHER PUBLICATIONS

"Thixoforming of Al Alloys Using Modified Chemical Grain Refinement for Billet Production by Wan et al International Conf Al Alloys: New Process Technologies" Ed Marina di Ravenna Italy 3–4 Jun. 1993 p. 115.

"Thixocasting of Steel" by Flemings and Young, 9th SDCE International Die Casting Exposition & Congress, Ed by Rick Jun. 6–7 1977, pp. 1–8.

*Primary Examiner*—J. Reed Batten, Jr.

*Attorney, Agent, or Firm*—Alan M. Biddison

[57] ABSTRACT

A temperature profile is determined of a metal sample for the metal to be converted to establish a temperature range indicative of a partially solid and partially liquid state of the metal. With this temperature profile, a metal preform is heated at a controlled rate from a temperature below the temperature range to a temperature within the range defined by the temperature profile to achieve a select percent by volume of liquid in the metal. This controlled heating to a desired temperature, which may be at a uniform rate, followed by holding at the desired temperature, thermally converts a dendritic structure of the material into a globular structure. The thermally converted metal preform is then recovered for subsequent use such as shaping into a desired article.

10 Claims, 4 Drawing Sheets

METHOD OF FORMING PRODUCT HAVING GLOBULAR MICROSTRUCTURE

FIELD OF THE INVENTION

The present invention is directed to a method of forming a metal having a semi-solid metal structure based on determining a volume percent liquid phase temperature profile for the metal to be formed.

BACKGROUND ART

The use of metals having a semi-solid metal structure for forming and shaping of various articles is well known in the prior art. Shaping of materials having a semi-solid metal structure is particularly desirable since the material is more easily shaped. Moreover, more complex shapes with close tolerances can be formed successfully.

The semi-solid metal structure has been produced in the prior art in a variety of ways. Semi-solid metal can be obtained by means of mechanical or electromagnetic agitation, controlled cooling or controlled heating.

U. S. Pat. No. 5,009,844 to Laxmanan discloses a semi-solid metal-forming process for aluminum-silicon alloys having 5 to 12 percent silicon therein. In this process, a solid billet of the aluminum-silicon alloy is heated to a temperature intermediate the liquidus temperature and the solidus temperature at a rate not greater than 30° C. per minute. This heating forms a semi-solid body of the alloy while inhibiting the formation of free silicon particles therein. The semi-solid body can then be formed into a desired configuration.

U.S. Pat. No. 4,694,881 to Busk discloses a process for forming a liquid-solid composition from a material which, when frozen from its liquid state without agitation, forms a dendritic structure. The material, having a non-thixotropic-type structure in a solid form, is fed into an extruder. The material is heated to a temperature above its liquidus temperature and then cooled to a temperature less than its liquidus temperature and greater than its solidus temperature while being subjected to sufficient shearing action to break at least a portion of the dendritic structures as they form. The material exiting the extruder can then be utilized as desired.

U.S. Pat. No. 4,771,818 to Kenney discloses a process for shaping a metal alloy in which the semi-solid metal alloy charge is shaped under pressure in a closed die cavity. The metal alloy is heated to form a liquid-solid mixture, the liquid-solid mixture being vigorously agitated to form discrete degenerate dendritic primary solid particles suspended homogeneously in a secondary liquid phase. The liquid-solid mixture is then shaped in the closed die cavity.

One of the drawbacks relating to the production of semi-solid metals is the need for precise temperature control to achieve the target percent liquid in the metal to facilitate the transformation from a dendritic phase to a non-dendritic phase. In addition, not all metals, either ferrous or non-ferrous, are conducive to the formation of a semi-solid metal structure.

A need has developed to provide techniques for thermally converting metals to a semi-solid metal structure for subsequent shaping operations such as extrusions or the like. In response to this need, the present invention provides a method which enables the formation of a semi-solid metal structure in a given material. First, a temperature profile is determined for the given material which establishes a temperature range corresponding to the onset of a liquid phase in the material, i.e. greater than 0% liquid, up to melting of the material, i.e. 100% liquid phase. Knowing this temperature profile and temperature range, a material can be precisely and uniformly heated and subsequently cooled to provide a semi-solid metal preform for subsequent shaping into a desired article.

SUMMMARY OF THE INVENTION

Accordingly, it is a first object of the present invention to provide a method for thermally converting a metal into a preform having a globular microstructure for subsequent shaping.

Another object of the present invention is to provide a method for both thermally converting a metal into a semi-solid metal structure and shaping the converted metal by extruding, forging, rolling, impact extruding or the like.

A further object of the present invention is to provide a method for thermally converting a ferrous or non-ferrous material having a dendritic primary phase to a globular primary phase so that subsequent shaping operations use reduced shaping pressures and increased shaping speeds.

Other objects and advantages of the present invention will become apparent as a description thereof proceeds.

In satisfaction of these objects and advantages, the present invention provides a method of forming a metal having a semi-solid metal structure including selecting a metal to be thermally converted to the semi-solid metal state. After the metal has been selected, a temperature profile for the metal is determined. The temperature profile defines a temperature range corresponding to a liquid phase volume percent of the metal covering a desired range, such as between 0 and 100% liquid. With some alloy systems, the minimum volume % liquid encountered upon incipient melting could be 20% or higher. The profile is determined by heating a solid sample of the metal to a temperature slightly below that at which incipient melting is anticipated. The sample is.then heated at a controlled rate until melting occurs. Preferably, the controlled rate is a substantially uniform rate, such as 68° F. (20° C.) per hour or lower. The temperature profile for melting is thus determined.

After the temperature profile has been determined, a preform of the selected metal is initially heated to a temperature below that at which incipient melting is expected and is then heated at a controlled rate to a desired temperature within the range that is determined by the temperature profile and held for a period of time to provide a semi-solid metal preform having a defined volume percent of liquid.

In one mode of the invention, the semi-solid metal, after the controlled heating step, is cooled to room temperature, subsequently reheated and shaped into a desired article.

Alternatively, the semi-solid preform can be directly cooled to a desired shaping temperature and shaped to form an article.

The shaping techniques include extrusion, forging, rolling, impact extrusion and similar forming operations.

Although most ferrous or non-ferrous metals are adaptable to the inventive process, preferred metals include the aluminum alloys, either wrought or cast.

When determining the temperature profile and during the uniform heating step, a control material can be utilized to assure that the heat up of the metal to be profiled and uniformly heated is accurate. In a preferred embodiment, a copper material is used which is sized in dimension to approximate the thermal mass of the material to be converted by taking into account the specific heat of each material.

The present invention also produces products from the inventive process either as a preform or a shaped article.

BRIEF DESCRIPTION OF THE DRAWINGS

Reference is now made to the drawings of the invention wherein.

DESCRIPTION OF THE PREFERRRED EMBODIMENT

The present invention provides a method using thermal conversion to convert a solid metallic article into a form having a semi-solid metal structure. The semi-solid metal structure is typically a globular primary phase structure which is derived from a dendritic primary phase structure (usually a cast structure) present in the material prior to its thermal conversion. Formation of the semi-solid metal structure permits shaping of the material using lower shaping pressures and faster shaping speeds. Moreover, materials that were previously not conducive to shaping can now be successfully shaped into a desired article.

Formation of the globular primary phase structure is achieved by first determining a temperature profile of the metal to be thermally converted to the semi-solid metal structure. The inventive process can be adapted for most metals, either ferrous or non-ferrous, but is particularly suitable for aluminum alloys, both wrought types and cast types.

Figure 1:
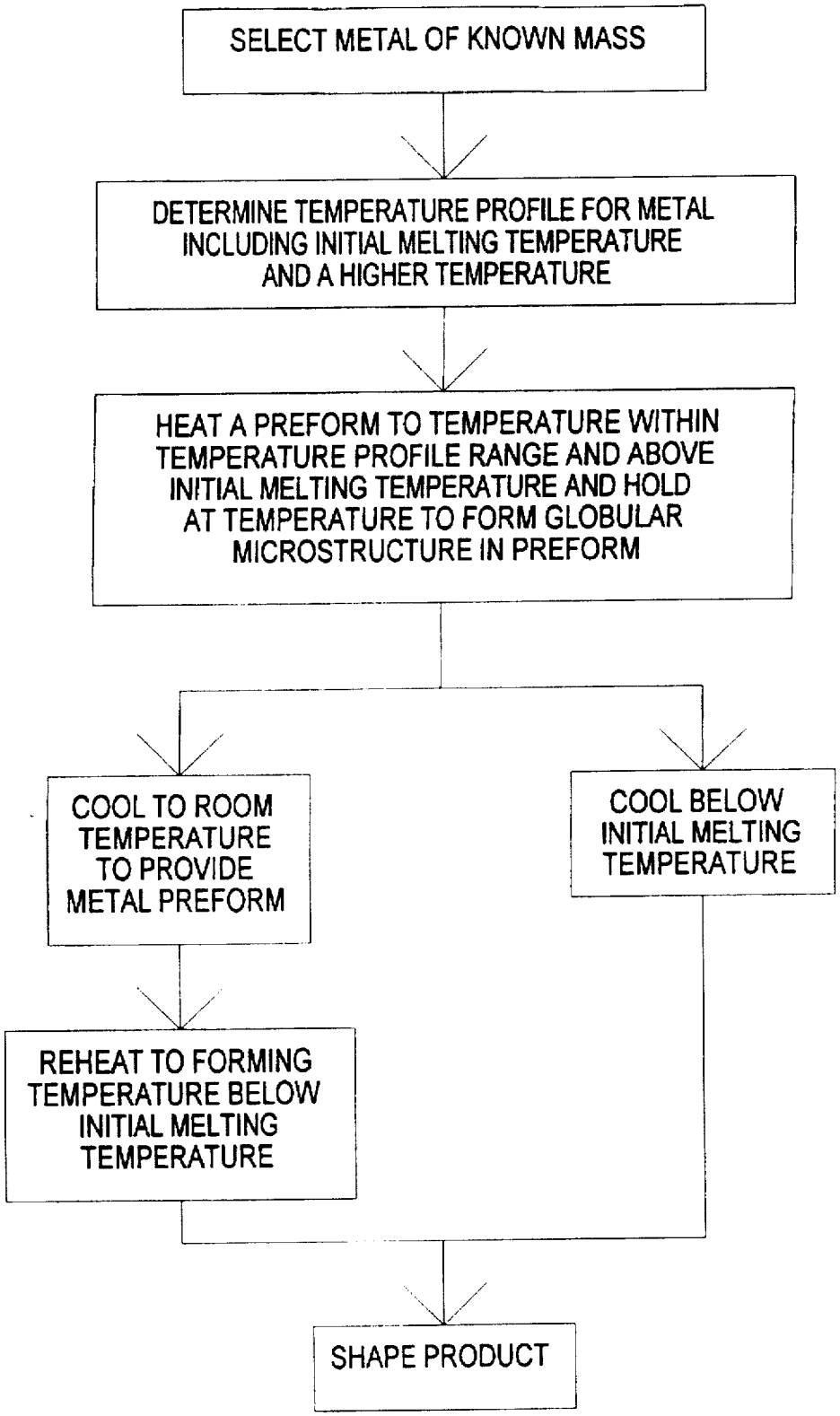
FIG. 1 is a flow diagram of a preferred mode of the method of the invention.

Referring to FIG. 1, a flow chart details the sequence of steps to thermally convert a given metal.

According to the invention, a metal to be thermally converted is selected. A temperature profile is then determined for this metal to establish a temperature range between incipient melting (a 0% by volume or higher liquid state) and a 100% by volume liquid state. As discussed previously, the lower limit of the volume percent could be greater than 0%, depending on the specific alloy composition.

Once this temperature profile is determined, the metal preform is heated at a controlled rate from a temperature below the lowest temperature of the temperature range during which melting occurs to a desired temperature within the range and is then held at the desired temperature for a specific time to provide a preform having the desired percent liquid. The combination of controlled heating and holding the preform at the desired temperature thermally converts the dendritic primary phase structure of the selected metal to a globular primary phase structure so as to form the semi-solid metal structure in the material. The thermally converted metal preform is then recovered.

In one mode of the invention, the thermally converted metal can be cooled to room temperature to provide a preform having a globular primary phase structure. The preform can be reheated to a shaping temperature for a working operation that forms a desired product or article.

In another mode, the thermally converted semi-solid metal can be directly cooled to a shaping temperature and shaped to form a desired article. It should be understood that the shaping step of a invention can be any known shaping process adaptable for metals. Examples included extruding, forging, rolling, impact extruding or the like.

By determining the specific temperature profile for a given material, a material to be thermally converted can be precisely heated to a specific temperature to achieve the target percent liquid and the desired semi-solid metal structure. Determination of the temperature profile can be achieved using the apparatus depicted in FIG. 2. Therein, the metal is in the form of a block 1 positioned in a crucible 3, the block 1 and crucible 3 being in a furnace 5. The crucible 3 functions to contain the block, particularly if liquid is generated during heating. A thermocouple 7 is provided, the sensing end thereof positioned within the center of the block 1. The thermocouple 7 is connected to a recorder 9 and a plotter 11. The plotter 11 generates a temperature versus time profile which tracks the heating rate of the block 1.

Figure 3B:
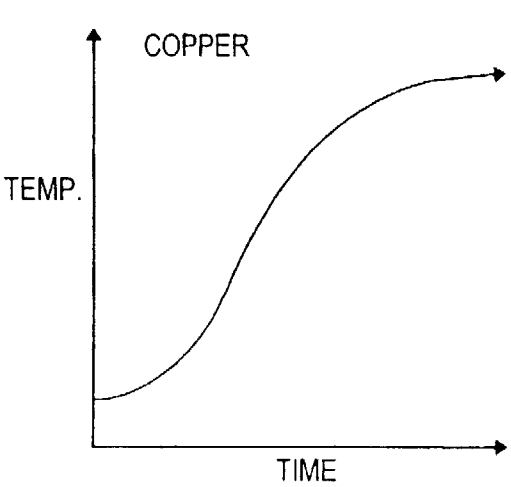
FIGS. 3*a* and 3*b* are exemplary temperature profiles obtained using the apparatus depicted in FIG. 2.
Figure 3A:
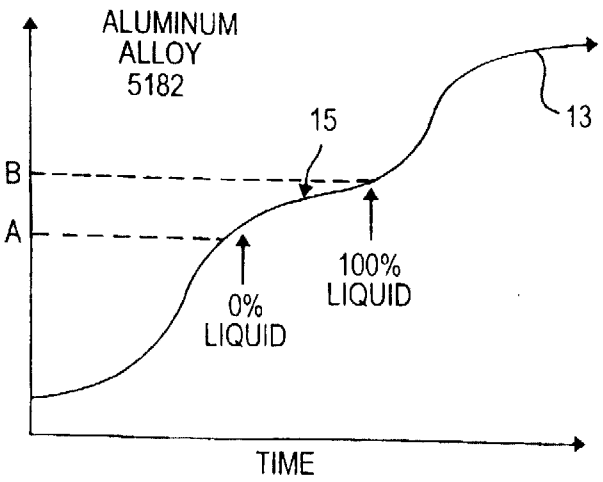

Exemplary temperature versus time profiles are shown in FIGS. 3*a* and 3*b* for an aluminum alloy and copper, respectively. The curve in FIG. 3*a* is typical of the heat up rate of an aluminum alloy. Due to the endothermic heat of transformation of the aluminum alloy from the solid state to the liquid state, the curve 13 shows a portion of decreased slope 15. This decreased slope portion is representative of the onset of melting of the aluminum alloy, this onset designated by the 0% liquid arrow. As the aluminum alloy is continuously heated, the alloy continually converts from the 0% liquid state to a partially liquid-partially solid state along the decreased slope portion 15 of the curve 13. Ultimately, the aluminum alloy reaches the 100% liquid state as shown by the arrow in FIG. 3*a*. This decreased slope portion identifies a temperature range defined by letters "A" and "B" which corresponds to the partially liquid-partially solid state of the metal.

When determining the temperature profile for a given material, a control material can also be used as a direct comparator to understand the effect of the furnace heating conditions on the sample. Preferably, a block of copper is used since it does not melt under the furnace conditions when profiling an aluminum material. The copper temperature profile is depicted in FIG. 3*b*.

Figure 2:
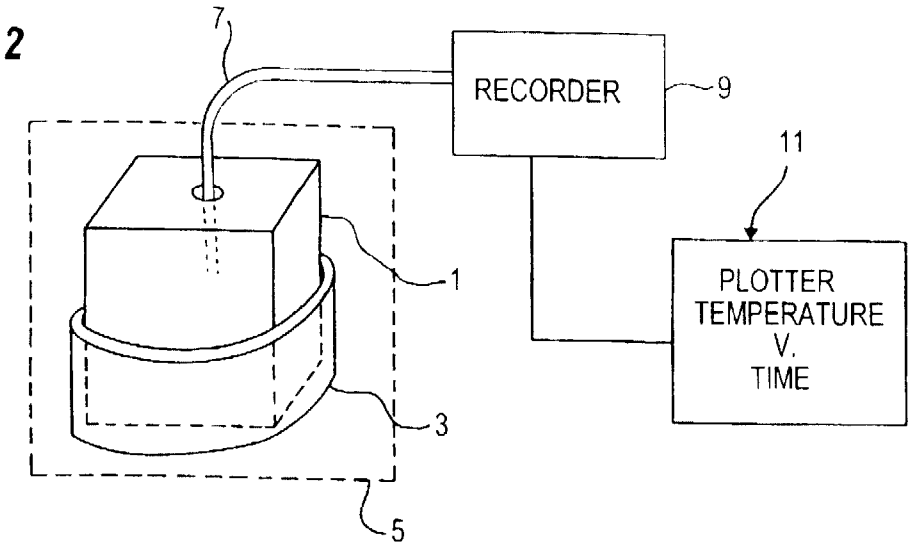
FIG. 2 is a schematic diagram of an apparatus used in conjunction with the inventive method.

When using a control for determining the temperature profile of a selected metal, the copper block also has a thermocouple inserted in it similar to the arrangement depicted in FIG. 2. Moreover, the copper block is dimensioned in a manner to eliminate or minimize any effect of the furnace profile on the material. That is, the equation:

$m_1s_1=m_2s_2$, wherein $m_1$=mass (g) of the aluminum alloy block;

$m_2$=mass (g) of the copper block;

$s_1$=the specific heat of the aluminum alloy block; and $s_2$=the specific heat of the copper block, is followed to size the copper block with respect to the mass of the aluminum alloy block.

By using a control material and its heating profile during uniform heating of a selected material, the temperature of the control material can be monitored or sensed to detect any upsets in the furnace conditions. If the sensed temperature profile of the control material does not correlate to that shown in FIG. 3*b*, an upset condition in the furnace may be present and the temperature profile of the material to be thermally converted may not be accurate. Monitoring of the control's temperature ensures that the selected material is heated in the furnace at the desired rate to achieve the semi-solid metal state.

Figure 4:
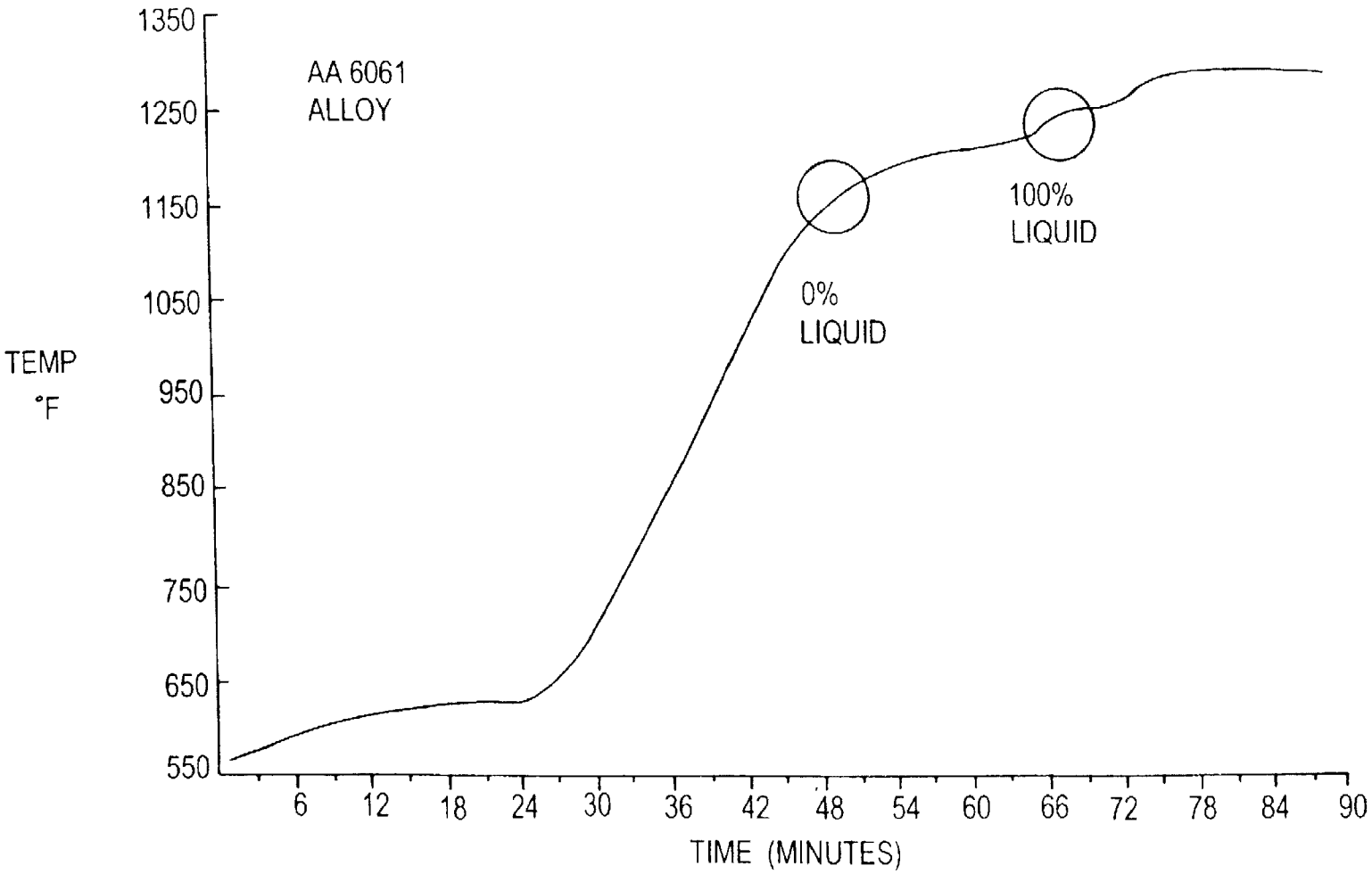
FIG. 4 is an actual temperature profile of a calcium-modified AA5182 alloy.
Figure 5:
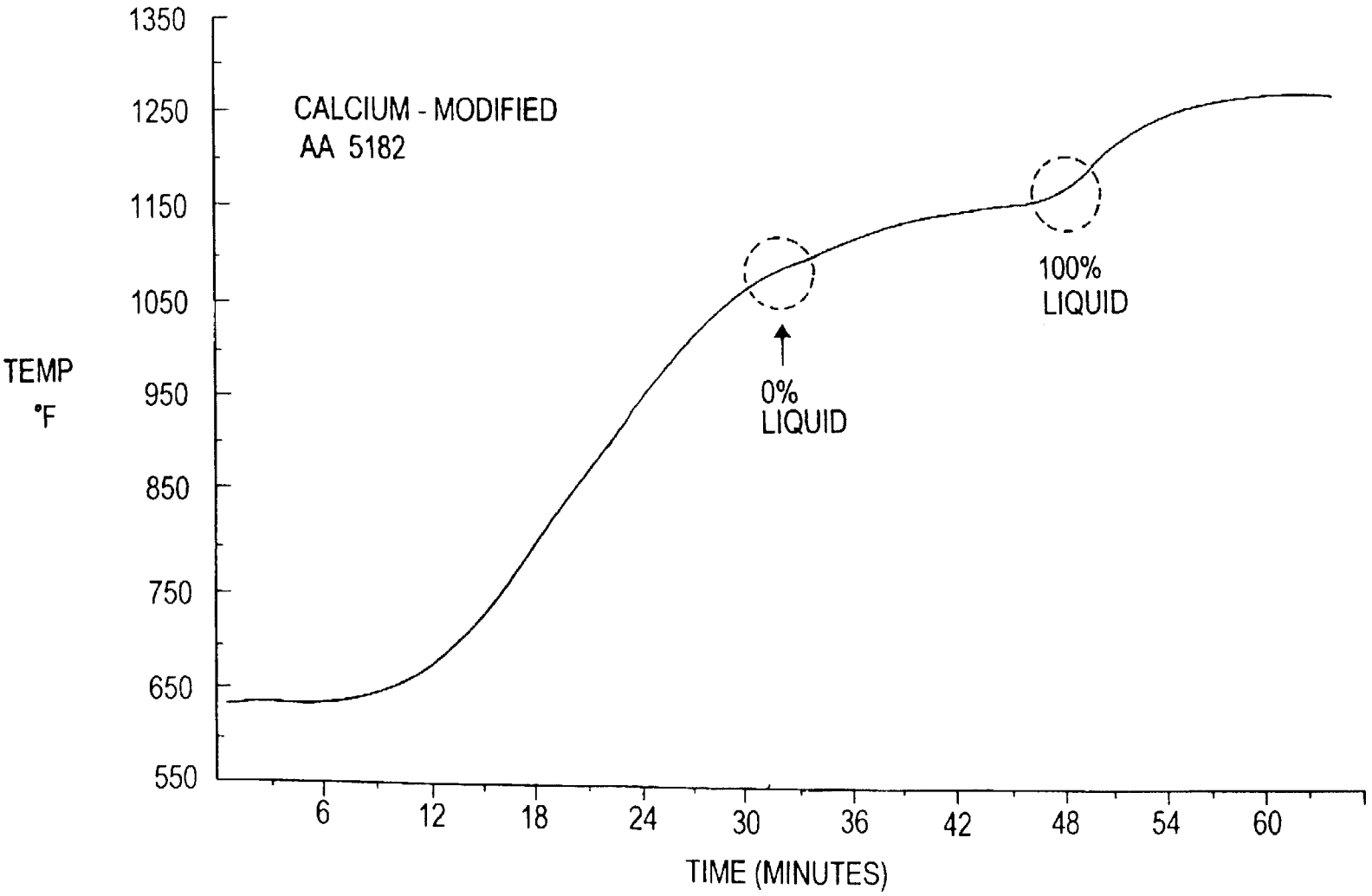
FIG. 5 is an actual temperature profile of an AA6061 alloy.

FIGS. 4 and 5 depict actual temperature profiles developed for two aluminum alloys. FIG. 4 represents an AA6061 alloy and FIG. 5 represents a calcium-modified AA5182 alloy. These temperature profiles were determined using the apparatus of FIG. 2.

In FIG. 4, the regions corresponding to 0% and 100% by volume liquid are encircled on the curve. Onset of melting, i.e., about 0% liquid, begins about 1145° F. (618° C.). Completion of melting occurs about 1250° F. (677° C.).

For FIG. 5, the onset of melting occurs about 1100° F. (593° C.), with completion of melting occurring about 1175° F. (635° C.).

Based on the temperature profile shown in FIG. 5, a calcium-modified AA5182 alloy having an as cast dendritic primary phase structure was heated up to 1142° F. (617° C.) and cooled down to room temperature. During the room temperature cooling, the sample block was investigated for a microstructure representative of a semi-solid metal structure, e.g., a globular primary phase structure. Microstructure analysis revealed that the calcium-modified AA5182 alloy showed a substantially globular primary phase structure.

Additional tests and trials were performed wherein the calcium-modified AA5182 alloy was heated up to 1126° F. (608° C.) for four hours and air cooled, heated up to 1125° F. (607° C.) for 27 hours and forced air cooled and heated up at 1125° F. (607° C.) for 27 hours and cold water quenched. Microstructural analysis of the materials subjected to these three heating and cooling regimens revealed significant globularization of the primary phase. It was noticed that the longer hold times (27 hours) did not produce a significant difference in the globular microstructure as compared to the four hour hold time.

Additional trials were conducted using the same heating and cooling conditions but performing the microstructural analysis at a different location in the metal block. This analysis again showed formation of a globular primary phase. In addition, it was noted that the intermetallics present in the microstructure were also rounded off. Globularization of the dendritic primary phase indicates that the properties of this material, even in the solid state, would be far better than an as cast and homogenized material. Hence, a significant reduction in shaping pressures could be anticipated. In addition, a significant increase in the shaping speed should also be obtained with this thermally converted material.

It is believed that thermally converting any material according to the inventive process should achieve the same benefits during shaping.

Once a temperature profile establishing the temperature range between 0% by volume and 100% by volume liquid is established, it is preferred to select a temperature within this range which does not form too much liquid. Formation of an excessive amount of liquid can cause material handling problems if the material is to be subsequently shaped immediately after the thermal conversion step.

The temperature at which the metal is thermally converted also depends on the specific metal composition. Heating to a temperature which causes an excessive amount of volume percent liquid may also adversely affect the desired semi-solid metal structure for optimum shaping. During the thermal conversion, it is preferred to avoid melting of the primary phase but some melting is not detrimental to the inventive process.

The period of time for uniformly heating the material to be thermally converted is also dependent upon the chosen material. As described above, microstructural analysis revealed that sufficient conversion of the dendritic primary phase to a globular primary phase occurred after only four hours of heating at a temperature within the 0% to 100% by volume liquid temperature range. This period of time can be optimized based upon determining that a sufficiently globular microstructure occurs when heating to a given time and temperature.

Alternatively, the temperature profile can be used wherein, for a given mass, a temperature corresponding to a target vol. % liquid is reached in a set period of time. Knowing the mass of the material to be thermally converted, the time to reach the target temperature and vol. % liquid can be determined based on the known temperature profile such as that shown in FIG. 5. This, however, is true if the material to be heated is similar in shape to the control material and also the same furnace is used with the same material and final set temperature.

As stated above, the inventive method is especially suited for aluminum alloys, particularly any of the castable aluminum alloys such as A356 and AA1XXX, AA2XXX, AA3XXX, AA5XXX, AA6XXX, AA7XXX, AA8XXX alloys. In addition, the inventive method is suitable for ferrous materials which may benefit from the presence of a semi-solid metal structure for subsequent shaping.

As such, an invention has been disclosed in terms of preferred embodiments thereof which fulfill each and every one of the objects of the present invention as set forth hereinabove and provides a method for thermally converting a metal to have a semi-solid metal structure and products therefrom.

Of course, various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. A method of forming a wrought aluminum article having a globular primary phase structure comprising the steps of:

a) providing a sample of aluminum metal;

b) determining a temperature profile for said sample wherein said temperature profile defines a temperature range that includes the temperature at which incipient melting of the sample starts and a temperature higher than the incipient melting temperature of the sample;

c) providing a metal preform of a wrought aluminum alloy having a dendritic primary phase and the same composition as the sample;

d) heating said metal preform at a controlled rate from a temperature below that at which incipient melting of the sample started to a desired temperature above the incipient melting temperature and within said temperature range and holding the preform at the desired temperature for a period of time to form a heated metal preform having a globular primary phase;

e) cooling said heated metal preform to a solid state; and f) shaping said cooled metal preform in the solid state to provide a wrought article having a globular primary phase.

2. The method of claim 1 wherein said cooling step further comprises one of: (a): cooling said heated metal preform to a shaping temperature below the incipient melting temperature prior to said shaping of said cooled metal preform and (b) cooling said heated metal preform to room temperature, reheating said cooled metal preform to a shaping temperature below the incipient melting temperature prior to said shaping of said cooled metal preform.

3. The method of claim 2 wherein said shaping step comprises extruding, forging, rolling, or impact extruding.

4. The method of claim 2 wherein said heated metal preform is cooled and subsequently shaped.

5. The method of claim 2 wherein said heated metal is cooled, reheated and shaped.

6. The method of claim 1 wherein said provided metal preform of step c) has an as cast dendritic primary phase structure.

7. The method of claim 1 wherein said aluminum alloy is selected from the group consisting of AA1XXX, AA2XXX, AA3XXX, AA5XXX, AA6XXX, AA7XXX, AA8XXX aluminum alloys.

8. The method of claim 7 wherein said metal is one of an AA6XXX aluminum alloy and a calcium-modified AA5182 aluminum alloy.

9. The method of claim 1 wherein said metal is an AA6061 aluminum alloy and said temperature range is about 1145° F. (618° C.) to about 1250° F. (677° C.).

10. The method of claim 1 wherein said metal is a calcium-modified AA5182 aluminum alloy and said temperature range is about 1100° F. (593° C.) to about 1175° F. (635° C.).

* * * * *